US005862545A

United States Patent [19]

Mathis et al.

[11] Patent Number: 5,862,545

[45] Date of Patent: Jan. 26, 1999

[54] PRESSURIZED FLOW SELF-CLEANING WHIRLPOOL TUB SYSTEM

[76] Inventors: Cleo D. Mathis, 16209 Santa Bianca, Hacienda Heights, Calif. 91745; Robert A. Miller, 900 Valley View Pl., Fullerton, Calif. 92633

[21] Appl. No.: 931,746

[22] Filed: Sep. 16, 1997

Related U.S. Application Data

[63] Continuation of Ser. No. 506,115, Jul. 24, 1995, abandoned, which is a continuation-in-part of Ser. No. 266,359, Jul. 1, 1994, abandoned.

[51] Int. Cl.[6] ..... A61H 33/62

[52] U.S. Cl. ..... 4/662; 4/509; 4/541.1; 4/541.4

[58] Field of Search ..... 4/490, 541.1, 541.3, 4/541.4, 506, 662

[56] References Cited

U.S. PATENT DOCUMENTS

| | | | |
|---|---|---|---|
| 2,739,939 | 3/1956 | Leslie | 4/509 X |
| 4,563,781 | 1/1986 | James | 4/541.4 |
| 4,592,100 | 6/1986 | Robertson et al. | 4/541.4 |
| 4,979,245 | 12/1990 | Gandini | 4/662 X |
| 5,012,535 | 5/1991 | Klotzbach | 4/541.4 X |
| 5,383,239 | 1/1995 | Mathis et al. | 4/541.1 |

FOREIGN PATENT DOCUMENTS

| | | | |
|---|---|---|---|
| 3826001 | 2/1990 | Germany | 4/541.3 |
| 3901044 | 7/1990 | Germany | 4/541.3 |

*Primary Examiner*—Robert M. Fetsuga
*Attorney, Agent, or Firm*—Wallace G. Walter

[57] ABSTRACT

A pressurized-flow self-cleaning whirlpool tub system includes a plurality of water/air jets arranged to introduce air-entrained water jets into a tub basin and a suction outlet from which water in the tub basin is withdrawn. A water distribution circuit is connected to each of the water/air jets for delivering water to each water/air jet. A recirculation pump receives water from the tub basin, pressurizes the water, and delivers the pressurized water to the water distribution system. A cleaning-agent dispenser is provided to receive a cleaning agent in liquid or solid form and mix the cleaning agent with water from the pressurized water supply. In a cleaning mode of operation, a suction valve is closed and the cleaning agent is introduced into the water carrying conduits to effect pressurized cleaning of the water contacting surfaces of the water pathway.

2 Claims, 11 Drawing Sheets

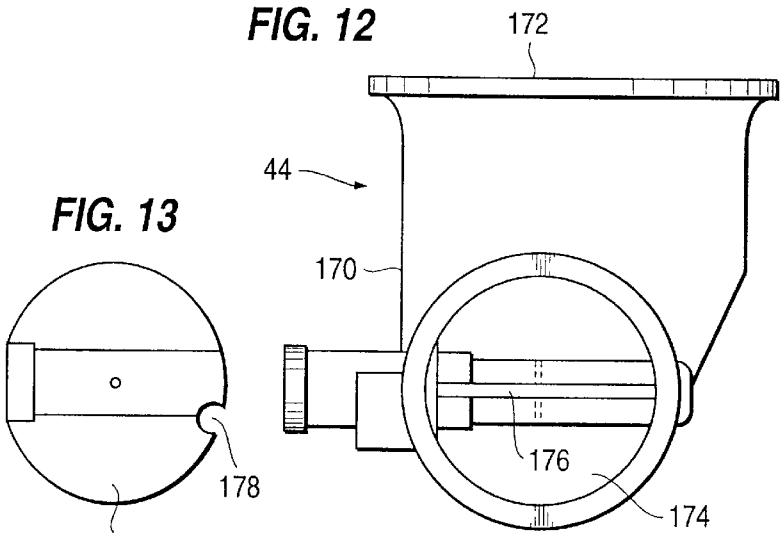
FIG. 12
FIG. 13
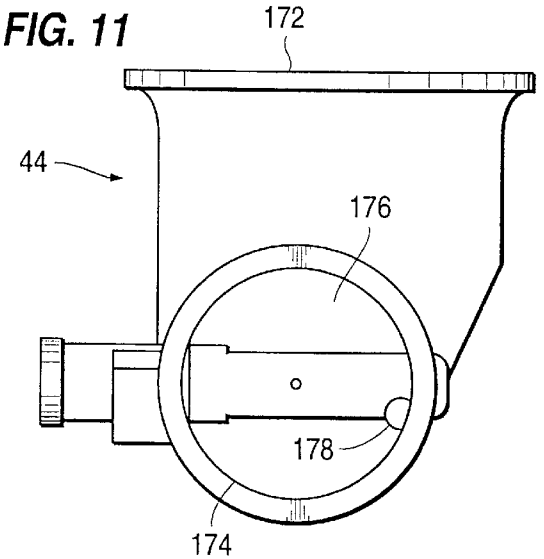
FIG. 11
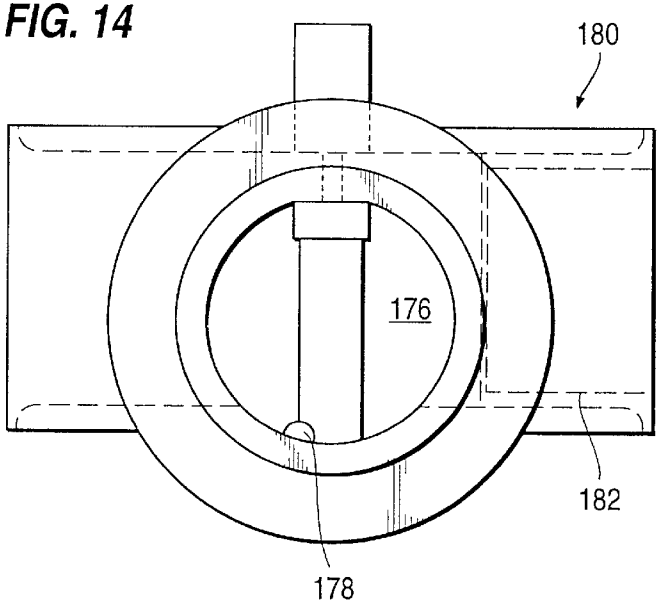
FIG. 14

PRESSURIZED FLOW SELF-CLEANING WHIRLPOOL TUB SYSTEM

CROSS-REFERENCE TO RELATED APPLICATION

This application is a continuation of application Ser. No. 08/506,115 filed Jul. 24, 1995, now abandoned which is a CIP of Ser. No. 266,359, Jul. 1, 1994, abandoned.

BACKGROUND OF THE INVENTION

The present invention relates to a pressurized-flow self-cleaning whirlpool tub system and, more particularly, to a self-cleaning whirlpool system and method that is both relatively simple in design and efficient in use.

Whirlpool tub systems typically include a tub structure which have water/air jets designed to introduce streams of pressurized water and air into the tub. Water is typically withdrawn from the tub through a suction inlet, pressurized in a recirculation pump, and distributed to the water/air jets through a water distribution line for re-introduction into the tub basin.

During normal use, the recirculated water includes various types of contaminants, including dirt, bacteria, skin cells, and oils. The contaminants are deposited as a thin layer on the interior surfaces of the various water-carrying conduits and represents a sub-optimal sanitary condition.

Various techniques and procedures have been developed to clean the water-handling system of whirlpool bath systems. For example, the tub basin can be filled with water and an appropriate cleaning agent added to the water (typically a detergent, deodorant, and/or disinfectant) and the tub system operated in the usual manner to circulate the cleaning agent. After the cleaning cycle is completed, the tub is drained in the usual manner. The tub basin is thereafter refilled with clean rinse water that is recirculated to rinse the cleaning agent from the water conduits. In some cases, a second rinse cycle is indicated. After the rinse water is drained from the tub basin, the surfaces of the tub are typically wiped clean. This cleaning technique is generally effective, although tub basins that are relatively large require a correspondingly large volume of the cleaning agent to achieve an effective concentration in the circulated water. Additionally, the requirement for one or more rinse cycles results in a large volume of water being used. The time required to effect cleaning, including the final wipe-down of the tub surfaces, results in labor costs that may be inconsistent with commercial whirlpool tub applications.

Other approaches have been developed to provide closed-loop recirculation through the water conduits. For example, U.S. Pat. No. 4,979,245 entitled "Self-Cleaning Whirlpool System for Bathtubs in General" discloses a representative closed-loop system in which a bypass conduit is provided to effectively isolate the water-carrying components from the tub basin. The recirculation pump is then operated to recirculate a cleaning agent within the water path. While such closed-loop recirculation systems tend to be effective, they are also complex and expensive to install.

SUMMARY OF THE INVENTION

In view of the above, it is an object of the present invention, among others, to provide a pressurized flow self-cleaning whirlpool tub system and method that is simple in design and yet efficiently cleans the surfaces of the water paths in whirlpool tub systems.

It is another object of the present invention to provide a pressurized flow self-cleaning whirlpool tub system and method well-suited for stand pipe air entry whirlpool tub systems.

It is still another object of the present invention to provide a pressurized flow self-cleaning whirlpool tub system that is less expensive than competing designs and which operates in a time and cost efficient manner.

In view of these objects, and others, the present invention provides a pressurized flow self-cleaning whirlpool tub system and method in which a tub structure is provided with a plurality of water/air jets for introducing a water/air mixture into the tub basin. The water/air jets are preferably of the stand pipe air-entry type in which a flow of water through the jet assembly functions to entrain ambient air supplied through a stand pipe into the water flow. A water distribution circuit is in communication with each water/air jet assembly and provides water to that assembly for mixing with entrained air and forcible discharge into the tub basin. A recirculation pump has its inlet side connected to a suction inlet line for drawing water from the tub basin and pressurizing that water for distribution to the water/air jet assemblies through the water distribution circuit. A valve is located in the suction path and operates between an open position during the normal operating mode and a substantially closed position during the self-cleaning mode of operation. The suction-path valve may be in the form of a user operative valve, or, more preferably, a valve that automatically self-configures depending upon the mode of operation. A cleaning agent dispenser connects to the water circuit and receives a cleaning agent, in solid or liquid form, and is also connected to the pressurized water supply. During the self-cleaning mode of operation, the cleaning agent dispenser functions to discharge the cleaning agent into the water flow used to clean the system.

In normal operation, the tub basin is filled to a desired level by the user. With the suction path valve and the various water/air jet assemblies in their open position, the recirculation pump is started to withdraw water from the tub basin through the suction inlet, pressurize the water, and return the water with entrained air through the water/air jet assemblies.

In the self-cleaning mode, a cleaning agent in liquid or solid form is introduced into a cleaning agent dispenser for mixing with hot and/or cold water from the pressurized water source. All the water/air jets except for the lower most water/air jet(s) and the suction path valve are closed. A mixture of water and cleaning agent is then introduced under pressure into the water carrying path to effect system-wide cleaning.

In the preferred form of the invention, the suction path valve includes a passageway that allows the cleaning agent to flow through the valve when closed to assure that all surfaces on the suction side of the recirculation pump are exposed to the cleaning agent.

The present invention advantageously provides a pressurized flow self-cleaning whirlpool tub system and method that is effective in operation and yet simple to use and relatively inexpensive to manufacture and install.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 11 is a view of a suction valve in the closed position;

FIG. 12 is a view of the suction valve in the opened position;

FIG. 13 is a plan view of a rotatable valving disc used in the suction valve of FIGS. 8 and 9;

FIG. 14 is a view of an alternate embodiment of a suction valve showing the valve disc in the closed position;

DESCRIPTION OF THE PREFERRED EMBODIMENT

Figure 1:
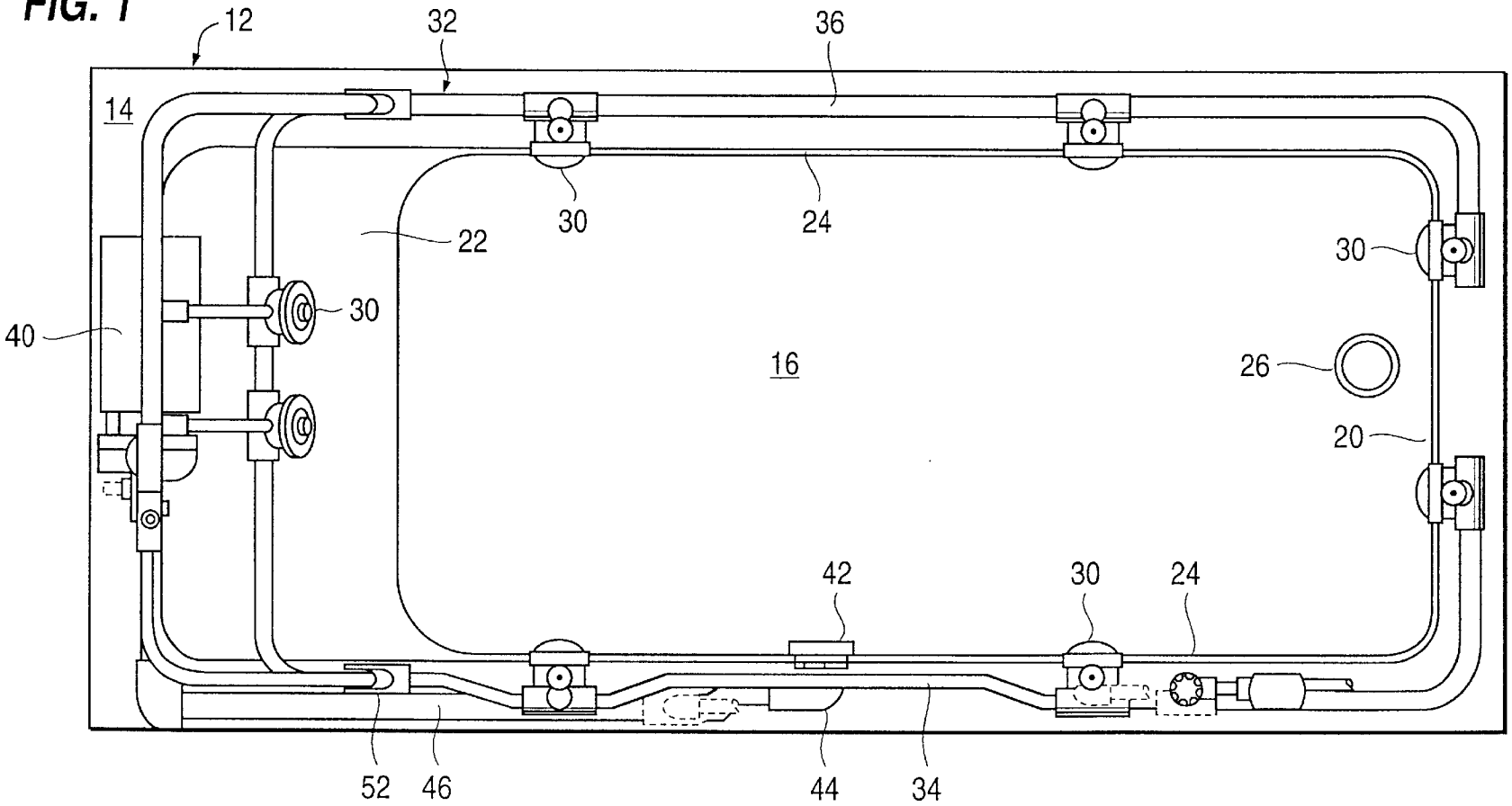
FIG. 1 is a top elevational view of a pressurized-flow self-cleaning whirlpool tub system in accordance with the present invention.
Figure 2:
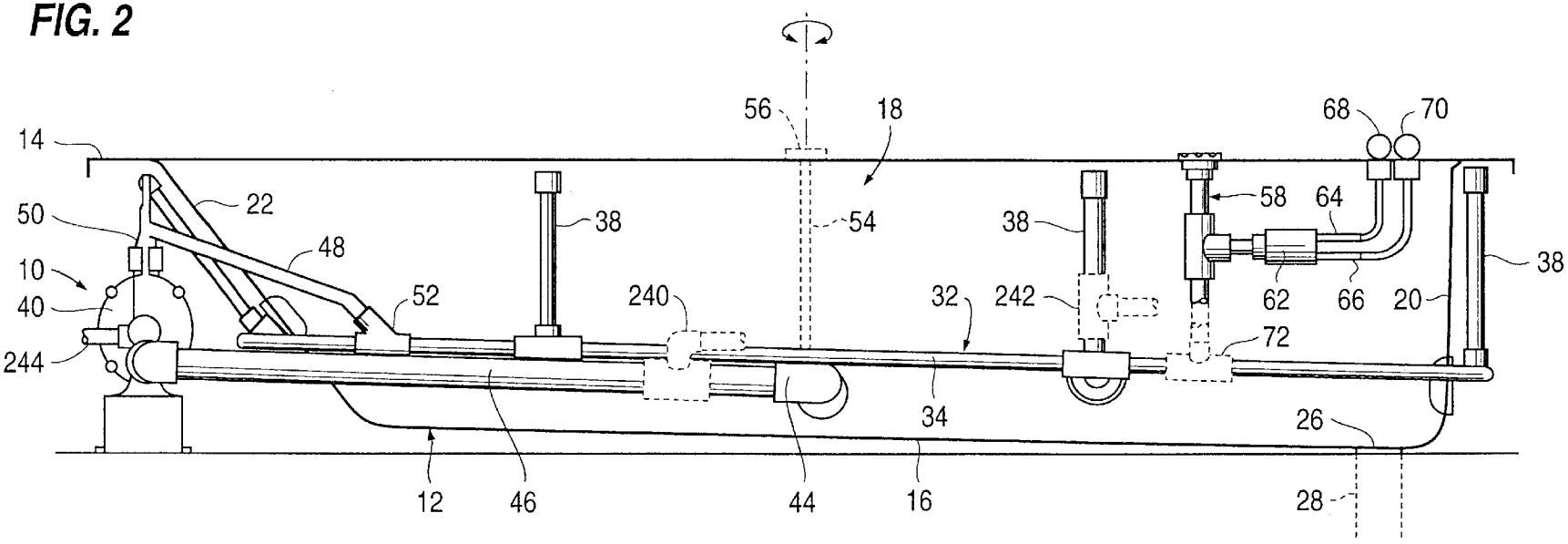
FIG. 2 is a side view of the self-cleaning whirlpool tub system of FIG. 1.

A pressurized-flow self-cleaning whirlpool tub system and method in accordance with the present invention is shown in FIGS. 1 and 2 and is designated generally therein by the reference character 10. As shown, the system 10 is designed to be mounted upon a tub structure 12 that includes a top sill 14, a bottom surface 16, and tub sidewalls extending between the top sill 14 and the bottom surface 16 to define a water-receiving basin 18. The tub sidewalls include a foot wall 20, a head wall 22 that is inclined relative to the bottom surface 16, and two opposed long walls 24. A drain opening 26 is shown on the right in FIGS. 1 and 2 and connects to a drain pipe 28 for emptying the basin 18 after use. The tub structure 12 is typically fabricated as a one-piece structure from fiber-reinforced plastic or similar material as is the custom in the industry; the configuration shown in FIGS. 1 and 2 is representative.

A plurality of water-air jets 30, described more fully below, are mounted in appropriately sized apertures (unnumbered) in the tub sidewalls. The water-air jets 30 include two water-air jets 30 in each long wall 24, two water-air jets 30 in the head wall 22, and two water-air jets 30 in the foot wall 20. As shown on the right in FIG. 2, the water-air jets 30 in the foot wall 20 are at a lower elevation relative to the other water-air jets 30.

A water circuit 32 connects the various water-air jets 30 in series circuit and supplies water to each water-air jet 30 for introduction into the tub structure 12. As shown in FIG. 2, a water conduit, such a PVC pipe 34, connects one water-air jet 30 in the foot wall 20, two water-air jets 30 in the lower long wall 24, and one water-air jet 30 in the head wall 22. Another PVC pipe 36 similarly connects the other water-air jet 30 in the foot wall 20, the two water-air jets 30 in the upper long wall 24, and the other water-air jet 30 in the head wall 22 in series. As explained in more detail below, each water-air jet 30 also includes a stand pipe 38 through which ambient air enters the respective water-air jet 30 and is entrained with the water to provide an air/water flow into the tub structure 12.

As shown on the left in FIG. 1, a recirculation pump 40 is provided to recirculate water from the tub structure 12. The recirculation pump 40 is of conventional design and preferably takes the form of the pump assembly disclosed in U.S. Pat. No. 5,408,708, issued Apr. 25, 1995, to Cleo D. Mathis and entitled "Improved Flow-Control for a Pump."

As best shown in FIG. 1, a suction inlet 42 is provided in the lower mid-portion of the tub structure 12 and connects through a suction valve 44 to a suction pipe 46 that is connected to the inlet of the recirculation pump 40. An outlet pipe 48 is connected between the pump outlet 50 and a Y-fitting 52 in the water circuit 32. During the time that the recirculation pump 40 is operative, water is withdrawn through the suction inlet 42 and the open suction valve 44 into the suction pipe 46 and into the inlet of the recirculation pump 40. The water is pressurized by the recirculation pump 40 and then introduced through the outlet pipe 48 and the Y-fitting 52 into the water circuit 32 for discharge through the various water-air jets 30 into the tub structure 12.

A cleaning-agent dispenser 58 is mounted to the top sill 14 and includes a removeable cap 60. The cleaning-agent dispenser 58 is connected through an anti-siphon valve 62 typically connected to the hot-water line 64 and/or the cold-water line 66. In most applications, the hot-water line 64 and the cold-water line 66 will be supplied from the municipal water supply system, although in some applications, such as shipboard applications, the hot-water line 64 and the cold-water line 66 are connected to the on-board water supply system. The hot-water line 64 and the cold-water line 66 are connected to a user-controllable hot-water valve 68 and a cold-water valve 70, respectively, to control the quantity and temperature of the water introduced through the cleaning-agent dispenser 58. A cleaning agent, such as a detergent, disinfectant, and/or deodorant combination in liquid, powder, or tablet form, is introduced into, i.e. received by the cleaning-agent dispenser 58, and, as explained more fully below, is mixed with water from the hot-water line 64 and the cold-water line 66 and introduced into the water circuit 32 through a water circuit fitting 72, as shown in dotted line. As explained below, the water/cleaning solution mixture can be introduced at other points in the system water path as a function of the specific application.

Figure 3:
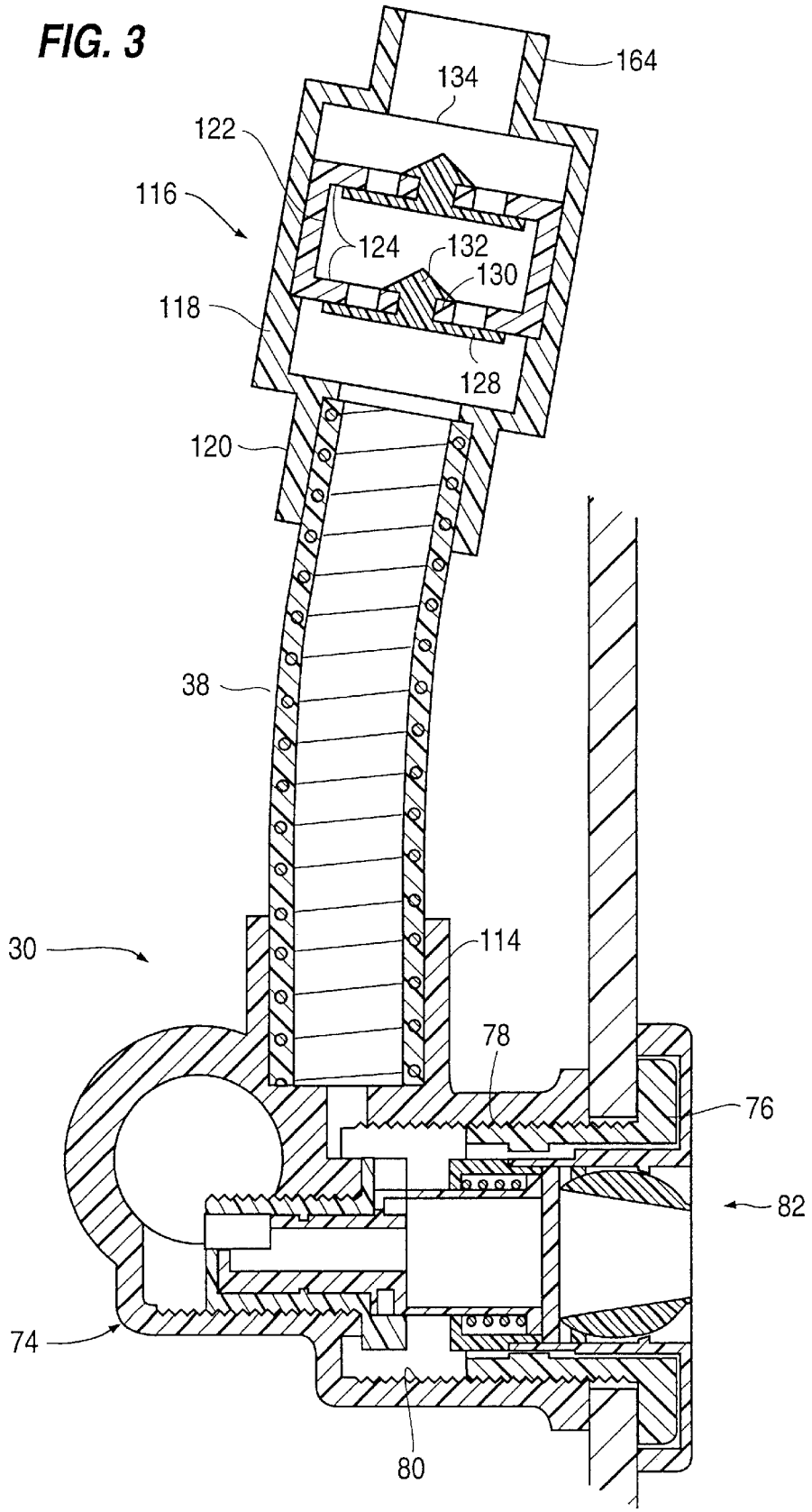
FIG. 3 is a side elevational view, in cross-section, of an exemplary water jet assembly.

An exemplary water-air jet 30 is shown in elevational cross-section in FIG. 3. As shown, the water-air jet 30 includes a jet housing 74 and retaining cap 76 having an externally threaded extension 78 that passes through an appropriately dimensioned through opening (unnumbered) in the tub sidewall and engages an internally threaded bore 80 of the jet housing 74. A sealing gasket (not shown) assures a fluid-tight connection. A user-rotatable core assembly 82 (FIG. 4) is contained within the jet housing 74 and can be adjusted to control the quantity of water/air flow from a closed position to an open position and also controls the direction of flow into the basin 18.

Figure 4:
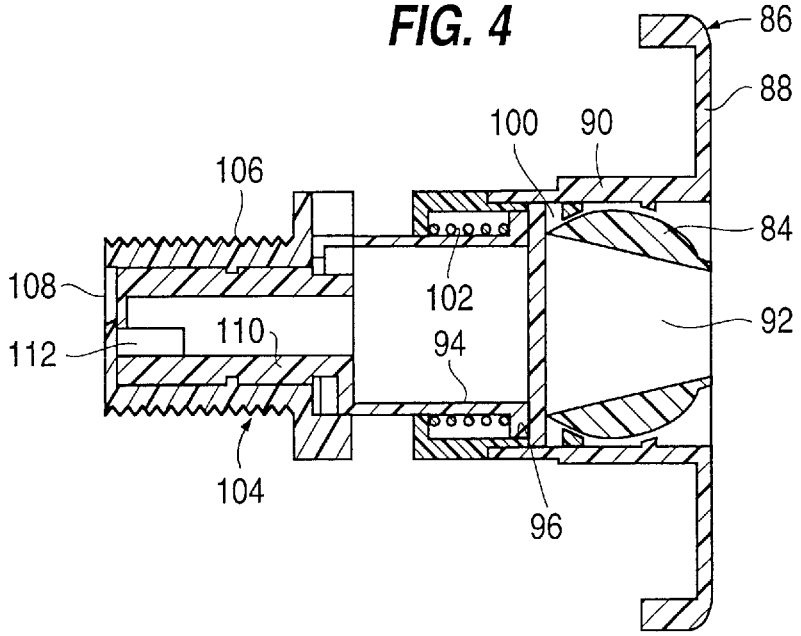
FIG. 4 is a side elevational view, in cross-section, of a core sub-assembly of the water jet of FIG. 3.

As shown in FIG. 4, the core assembly 82 includes an apertured spheroid 84 moveably mounted in a facia 86 and which functions as a user-adjustable nozzle. The facia 86 includes a flange 88 that is presented to the basin 18 and includes a generally cylindrical extension 90 that carries the spheroid 84. A generally converging thru-passage 92 is provided in the spheroid 84 through which the water emerges in a jet-like manner into the basin 18. A hollow retainer tube 94 is mounted in the extension 90 and includes an outwardly extending flange 96 that slides within the extension 90. A sealing ring 100 is positioned between the outwardly extending flange 96 and the spheroid 84. A helical spring 102 is mounted in an annular space (unnumbered) between the extension 90 and the retainer tube 94 and resiliently biases the outwardly extending flange 96 and the sealing ring 100 against the spheroid 84. A valve extension 104 is connected to the end of the retainer tube 94 opposite the spheroid 84 and is designed to respond to user-rotation of the facia 86 to control the flow of water and air through the water-air jet 30. The valve extension 104 includes a hollow externally threaded valve seat 106 that is threaded into the jet housing 74 and which includes a water entry port 108 that is in communication with the water circuit 32. A hollow valve tube 110 is carried in the valve seat 106 and includes a cut-out 112 that can be rotated to communicate with the water entry port 108 (FIG. 3) whereby water from the water circuit 32 will flow through the cut-out 112 or can be rotated to a position (FIG. 4) in which water flow is blocked. A suitable core assembly is shown in U.S. Pat. No. 5,291,621 issued Mar. 8, 1994 to Cleo D. Mathis and entitled "Spa Jet Assembly."

As shown in FIG. 3, each of the water-air jets 30 includes a stand pipe 38 that is mounted in a pipe receiving collar 114 of the jet housing 74. In the embodiment of FIG. 3, the stand pipe 38 is a flexible or semi-rigid tube that can be repositioned by the installer as required by the physical restraints of the particular installation. Preferably, the stand pipe 38 is shape-sustaining, that is, the stand pipe 38 will remain in the position to which it is moved by the tub installer. The position of the stand pipe 38 may also be secured with a suitable clamp (not shown). When the core assembly 82 is adjusted to open the ports of the valve extension 104 and the valve seat 106, the flow of water through the core assembly 82 will entrain air from the stand pipe 38 into the water flow to provide an air/water mix as is known in the art. An example of an air-entraining whirlpool jet is disclosed in U.S. Pat. No. 3,890,655 issued Jun. 24, 1975 to Cleo D. Mathis and entitled "Whirlpool Jet for Bathtubs."

An air valve assembly 116 is mounted at the distal end of each stand pipe 38 and allows ambient air to enter the stand pipe 38 for entrainment with the water flow. The air valve assembly 116 will act to block any reverse flow outwardly of the stand pipe 38. As shown in FIG. 3, the air valve assembly 116 includes a generally cylindrical valve housing 118 having a reduced diameter collar 120 that receives the upper end of the stand pipe 38. A dual-valve cartridge 122 is mounted in the valve housing 118 and includes two parallel, spaced apart apertured partitions 124, each having a central opening (unnumbered) that accepts a flexible valve disc 126. Each flexible valve disc 126 is fabricated from a flexible elastomer and includes a discoidal portion 128 that normally overlays the air-passage apertures, a center stem 130 that extends through a central opening, and a head 132 retains the flexible valve disc 126 in place. When water is not flowing through the water-air jet 30, the discoidal portion 128 of each flexible valve disc 126 is normally in a covering relationship with the air-passage apertures to prevent any inadvertent water leakage outwardly from the stand pipe 38. Conversely, when water is flowing through the opened water-air jet 30, the discoidal portion 128 of each flexible valve disc 126 will flex away from their respective air passages to admit air into the stand pipe 38. The air admitted into the stand pipe 38 is then mixed with the water in the core assembly 82. The valve housing 118 extends a selected distance from the uppermost apertured partition 124 to provide a water-receiving reservoir 134 to accumulate any inadvertent or accidental water leakage from the stand pipe 38. A cylindrical extension 164 is formed at the upper end of the housing 118 for connection, depending upon the particular application, to additional piping. The air valve assembly 116 thus constitutes two 1-way valves in series communication with a reservoir 134 in communication with the more remote of the two valves.

Figure 5:
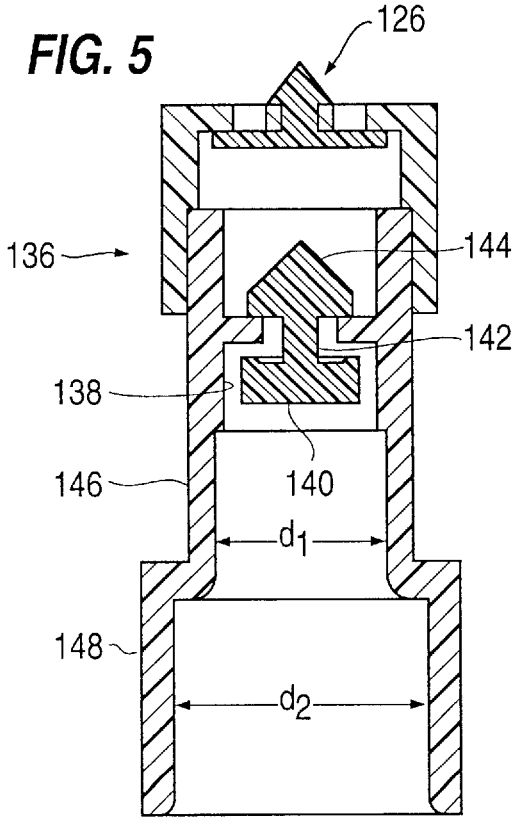
FIG. 5 is a side elevational view, in cross-section, of a design of a flow-direction control valve.

An alternate design for the air valve assembly 116 is shown in FIG. 5. As shown, the air valve assembly 136 includes a flexible valve disc 126 of the type described above in relation to FIG. 3 and a poppet-type valve. As shown, the poppet 138 in FIG. 5 includes a valving disc 140, a stem 142 that passes through a central opening (unnumbered) in the apertured partition 124, and a head 144 that retains the poppet 138 in place. The underside of the head 144 includes grooves or other passageways (not specifically shown) that allow air flow into the stand pipe 38 during normal operation. The lower portion of the valve assembly 136 includes two different-diameter pipe-accepting extensions, 146 and 148, so that the valve assembly 136 can be used with at least two different diameter stand pipes 38.

Figure 6:
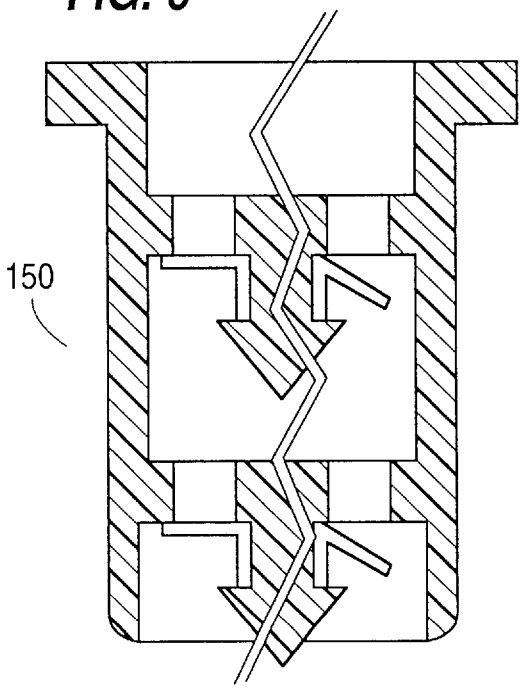
FIG. 6 is a side view, in cross-section, of an alternate design for a flow-direction control valve.

A second alternate design for the valve assembly is shown in FIG. 6 and includes two flex-type discs (unnumbered) contained within a housing 150 designed to be received within the remote end of the respective stand pipe 38.

Figure 7:
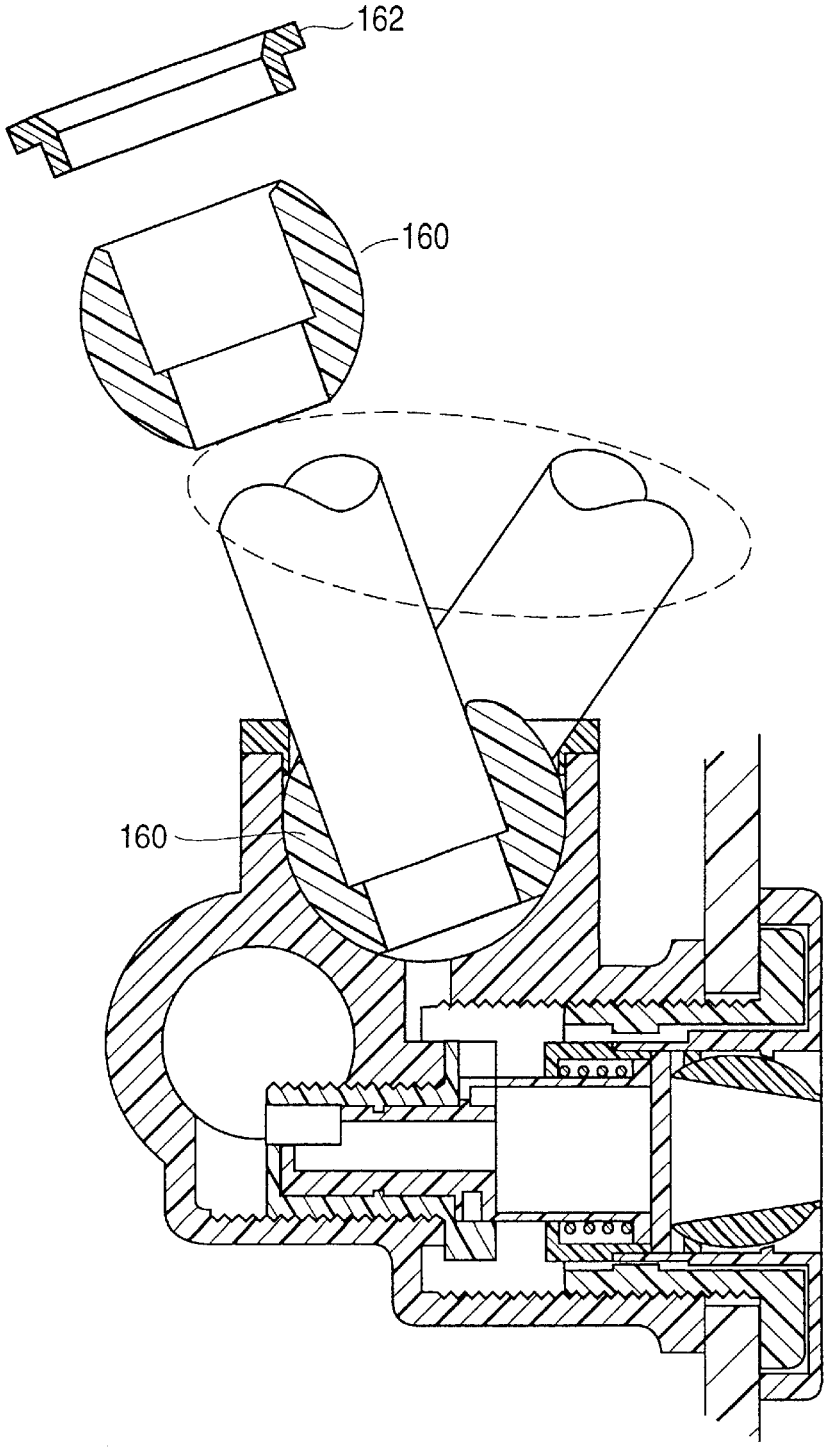
FIG. 7 is a side elevational view, in cross-section, of an alternate water jet structure.

An alternate structure for the mounting of the stand pipe 38 in a water-air jet 30 is shown in FIG. 7. As shown, the stand pipe 38 is formed as rigid tube that is received within an appropriately sized bore (unnumbered) in an adjustable ball 160. Once the stand pipe 38 is positioned by the installer in the desired position, the stand pipe 38, the ball 160, and a retainer ring 162 are cemented in place to secure the parts together.

Figure 8:
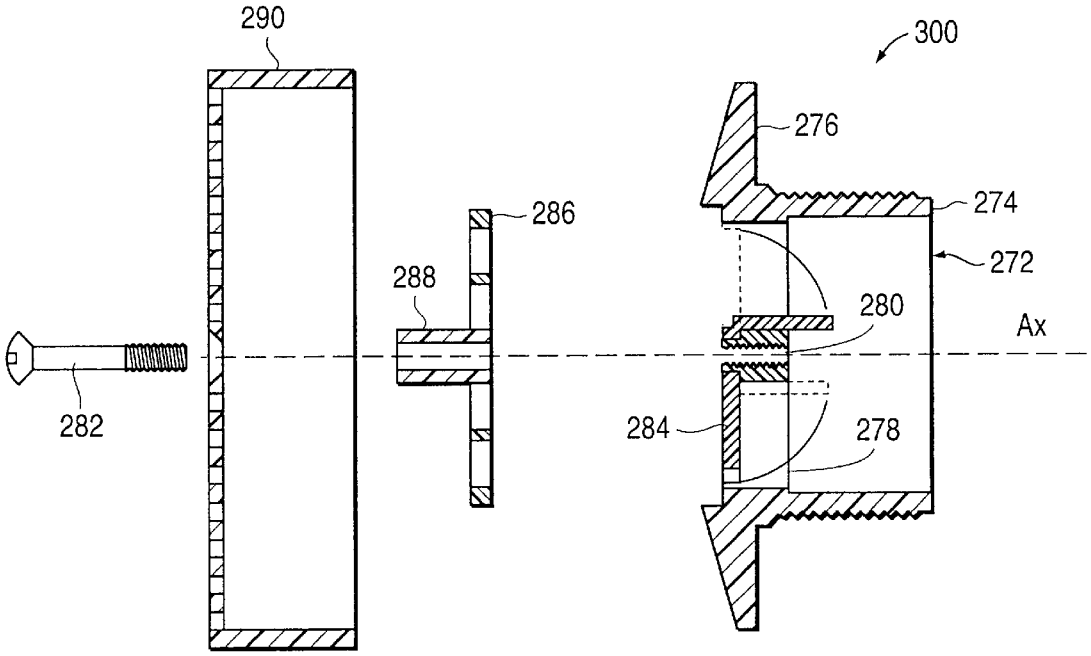
FIG. 8 is an exploded side view, in cross-section, of an integrated suction inlet and valve assembly.
Figure 9:
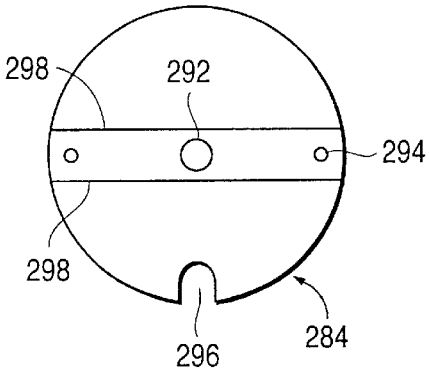
FIG. 9 is a plan view of a flexible elastomer valve disc.
Figure 10:
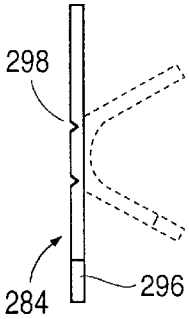
FIG. 10 is a side view of the flexible elastomer valve disc of FIG. 9 showing the disc in a flexed position (dotted-line illustration)

In the preferred embodiment, the suction inlet 42 takes the form of an integrated suction inlet and valve assembly shown in more detail in FIG. 8, FIG. 9, and FIG. 10 and designated therein by the reference character 300. As shown therein, the suction inlet 300 includes a body 272 formed about a longitudinal axis $A_x$ and having a hollow, externally threaded extension 274 and a radially extending flange 276. The extension 274 is designed to be fitted through an appropriately sized bore in the side wall 24 of the tub 12 and held in place with a suitable internally threaded retainer and gasket (not shown). A diametrically aligned bridge 278 extends across the internal bore of the extension 274 and includes an internally threaded bore 280 for receiving an assembly screw 282. A valve disc 284 is positioned on the bridge 278, and, as explained below, functions to control flow through the suction inlet 42 during either the normal whirlpool mode and the self-cleaning mode. A discoidal disc clamp 286, having a central stem 288, confines the valve disc 284 between itself and the bridge 278. Lastly, an apertured cover 290 is secured to the bridge 278 using the assembly screw 282.

The valve disc 284 is formed from a flexible elastomer, such as a silicone rubber, and, as shown in the plan view of FIG. 9, is formed as a circular member with a center hole 292, two locating alignment holes 294, a discharge opening 296, and, lastly, two spaced, parallel grooves or notches 298. When the valve disc 284 is assembled to bridge 278, the notches 298 are aligned along the opposite edges of the bridge 278 with the assembly screw 282 passing through the center hole 292. Accordingly, that portion of the valve disc 284 between the two notches 298 is captured between the bridge 278 and the clamp 286. The two locating alignment holes 294 receive pins (not shown) to prevent the valve disc 284 from rotating about the assembly screw 282. The two notches 298, which preferably have a square or rectangular cross-section, form reduced-thickness linearly extending zones that allow preferential bending of the valve disc 284. The discharge opening 296 is formed as a simple notch at the periphery of the valve disc 284 and functions to drain the cleaning solution from the system as explained more fully below. As shown in the side view of FIG. 10, the valve disc 284 has a first position (solid-line illustration) that corresponds to a substantially closed position, and a second position (dotted-line illustration) in which those portions of the valve disc 284 between the notches 298 and the periphery of the valve disc 284 can flex, as shown in FIG. 10.

While the integrated suction inlet and valve assembly 300 is the preferred embodiment, the system 10 can also use a separate, user-operable valve. The suction valve 44 that is connected between the suction inlet 42 and the suction pipe 46 of FIG. 1 is shown in its closed position in FIG. 11 and in its open position in FIG. 12. The suction valve 44 includes a valve housing 170 having an inlet side 172 for connection to the suction inlet 42 and an outlet side 174 for connection to the suction pipe 46. A valve disc 176 is rotatably mounted in the valve housing 170 and is rotatable between a first position (FIG. 11) in which the valve disc 176 substantially closes the suction valve 44 and an open position (FIG. 12) in which the flow between the suction inlet 42 and the outlet side is substantially unobstructed. The valve disc 176 is shown in plan view in FIG. 13 and includes a discharge opening 178 that is designed to prevent the suction valve 44 from closing completely. As explained below, the discharge opening 178 functions to permit drainage of the cleaning solution from the suction pipe 46 when the suction valve 44 is in its closed position and the system is in its self-cleaning mode.

An alternate embodiment of the suction valve 44 of FIGS. 11 and 12 is shown in FIG. 14. As shown, the suction valve 180 is configured as a "T"-shaped fitting in which one of the inlets in blocked by an insert 182 (dotted-line illustration). The valve disc 176 is of the same type shown in FIG. 13 and includes the discharge opening 178.

Figure 15:
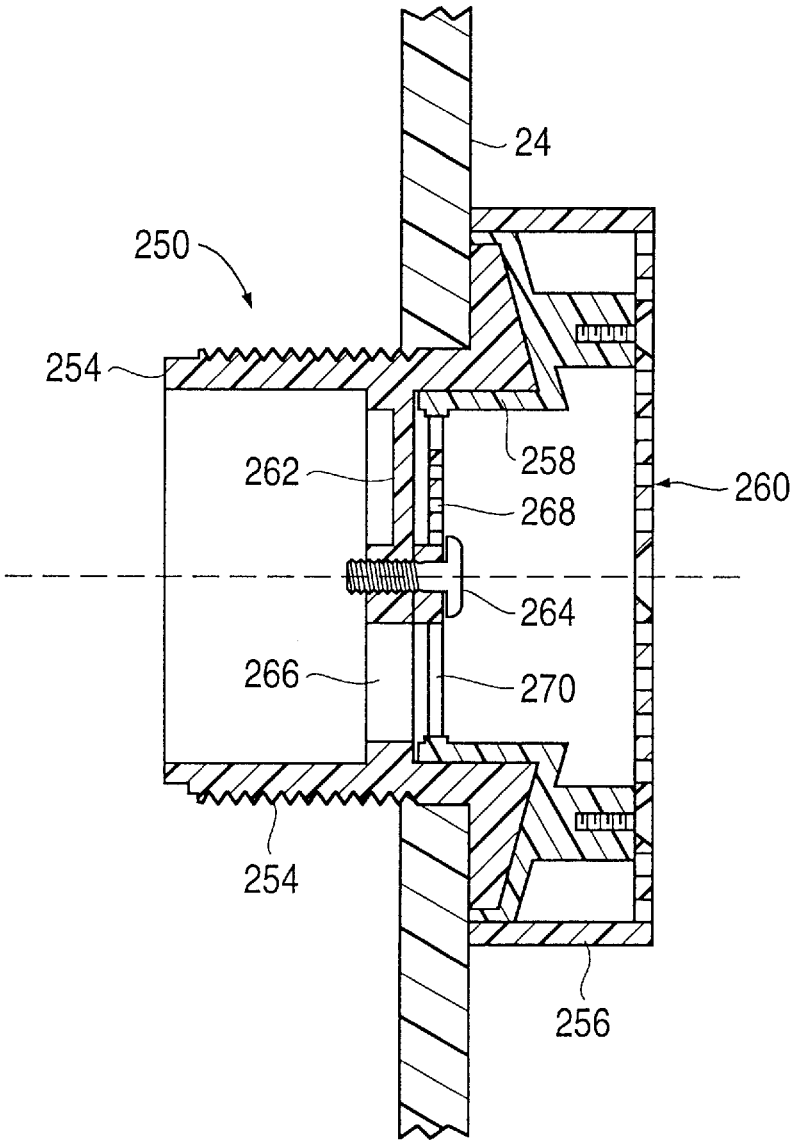
FIG. 15 is a side elevational view, in cross-section, of a user-adjustable valved suction inlet.

While integrated suction inlet and valve assembly 300 is preferred, a suction valve having a rotatable valve disc 176 with a discharge opening 178 is suitable as well as other types of valves, including ball, flapper, and poppet type valves can be used, provided a passageway, opening, hole, or clearance space is provided that is the functional equivalent of the discharge opening 296 or the discharge opening 178 described above. A valved suction inlet fitting that incorporates the above-described functions of the suction inlet 42 and the suction valve 44 is shown in side elevational view in FIG. 15. As shown, the valved suction inlet 250 includes an externally threaded housing 252 that extends through an appropriately sized thru-opening (unnumbered) in the tub wall 24 and is held in place by a clamp ring and sealing gasket combination (not shown). The end 254 interfaces with the suction pipe 46. A user-rotatable facia 256 is mounted on carrier element 258 and includes an apertured face portion 260 through which water is withdrawn into the suction pipe 46. The facia 256 and its connected carrier element 258 are rotatably connected to a valve seat 262 by a centrally positioned pivot 264. The pivot 264 may take the form of a threaded-fastener or a pin. The valve seat 262 includes a through opening 266 that has a sufficiently large area to accommodate the inlet water flow when water is being withdrawn from the tub basin 18 by the recirculation pump 40. The carrier element 258 includes a valve plate 268 that is positioned in a substantially parallel relationship to the valve seat 262 with a clearance space between the valve plate 268 and the valve seat 262. The valve plate 268 also includes an opening 270 that has a sufficiently large area to accommodate the inlet water flow when water is being withdrawn from the tub basin 18. Thus, when the facia 256 is rotated to the position shown in FIG. 15, the openings 266 and 270 are in substantial registration with one another to permit the required quantities of water to be withdrawn from the tub basin 18 and recirculated by the recirculation pump 40. In order to close the valved suction inlet 250, the user rotates the facia 256 one-half turn so that the opening 270 of the valve plate 268 is no longer co-aligned with the opening 266. In this substantially closed configuration, the flow of water through the opening 270 to and through the opening 266 is substantially constrained by the flow area presented by the clearance between the valve seat 262 and the valve plate 268. This clearance space (i.e., 0.125 to 0.250 inch) is the functional equivalent of the discharge opening 178 in the suction valve embodiments of FIGS. 8–15 and allows the pressurized filling of the water path.

In those applications where either the integrated suction inlet and valve assembly 300 or the manually operable valved suction inlet 250 is used, the valve 44 is eliminated from the suction path.

Figure 16:
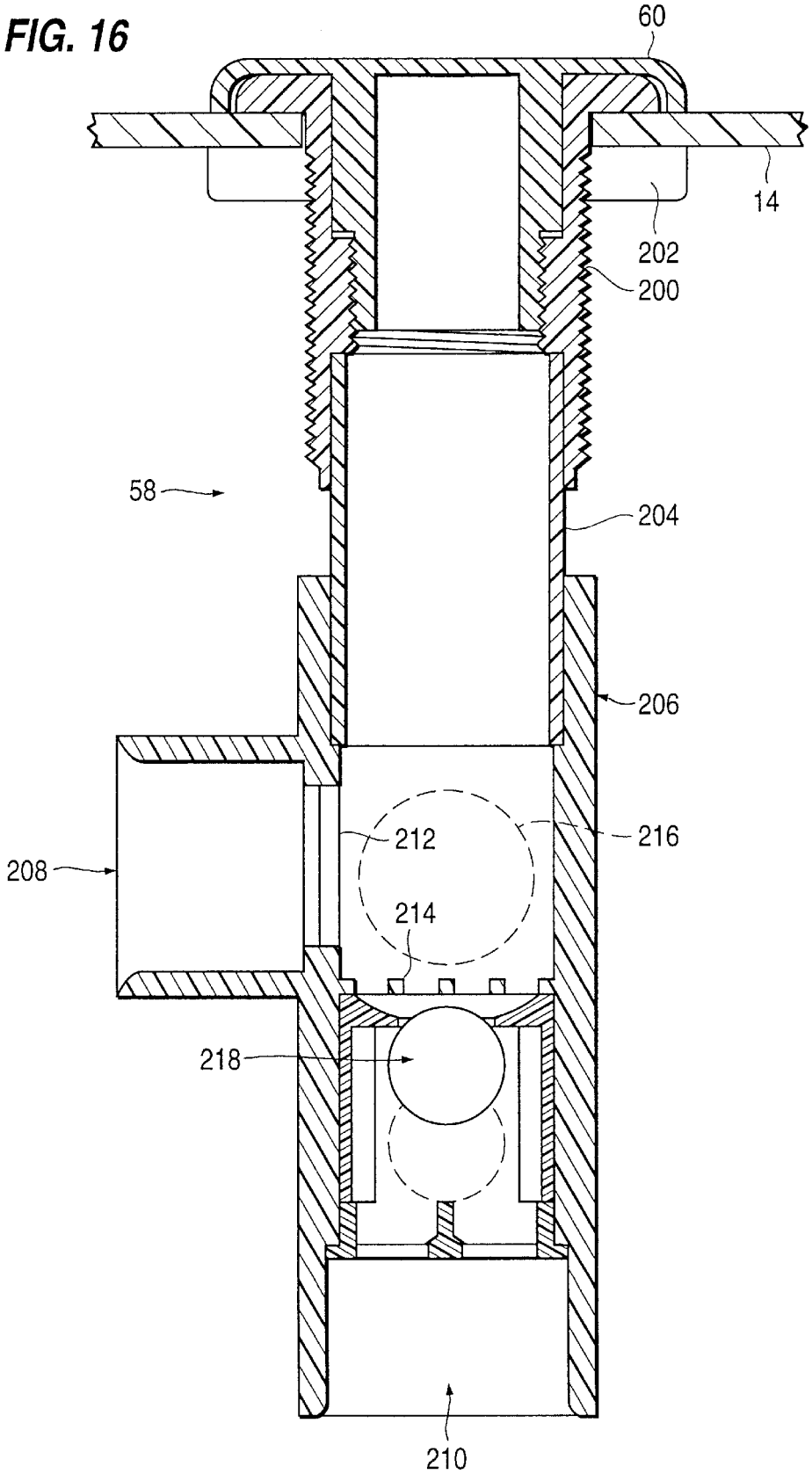
FIG. 16 is a side elevational view, in cross-section, of a first embodiment of a cleaning unit of the system of the present invention.

The cleaning-agent dispenser 58 is shown in side elevational view in FIG. 16 and is designed to be mounted in the top sill 14. As shown, an externally threaded mounting 200 extends through an appropriately sized opening (unnumbered) in the top sill 14 and is retained in place by an internally threaded clamp ring 202. The threaded removeable cap 60 is removeably engageable with internal threads in the interior of the mounting 200. A connecting tube 204 connects the lower end of the mounting 200 to the upper end of a T-connection 206. The T-connection 206 includes a pressurized water inlet 208 that communicates with the hot-water line 64 and the cold-water line 66 through the anti-siphon valve 62, as described above. An outlet 210 is located at the lower end of the T-connection 206 and communicates with the water circuit 32 (FIG. 1) for the purpose of introducing the cleaning mixture into the water circuit 32.

A plurality of spaced, vertical restraining bars 212 are positioned in the pressurized water inlet 208 and a plurality of spaced, horizontal restraining bars 214 define a volume into which a solid, water-soluble cleaning-agent tablet 216 (dotted-line illustration) is constrained. A ball-type 1-way check valve 218 is located below the spaced, horizontal restraining bars 214 to prevent any inadvertent backflow from the outlet 210. In normal use, the removeable cap 60 is unthreaded from the mounting 200, a solid, water-soluble cleaning-agent tablet 216 (dotted-line illustration) is deposited into the cleaning-agent dispenser 58, and the removeable cap 60 replaced. The tablet 216 normally rests on the spaced, horizontal restraining bars 214 and is prevented from movement into the pressurized water inlet 208 by the spaced, vertical restraining bars 212.

Figure 17:
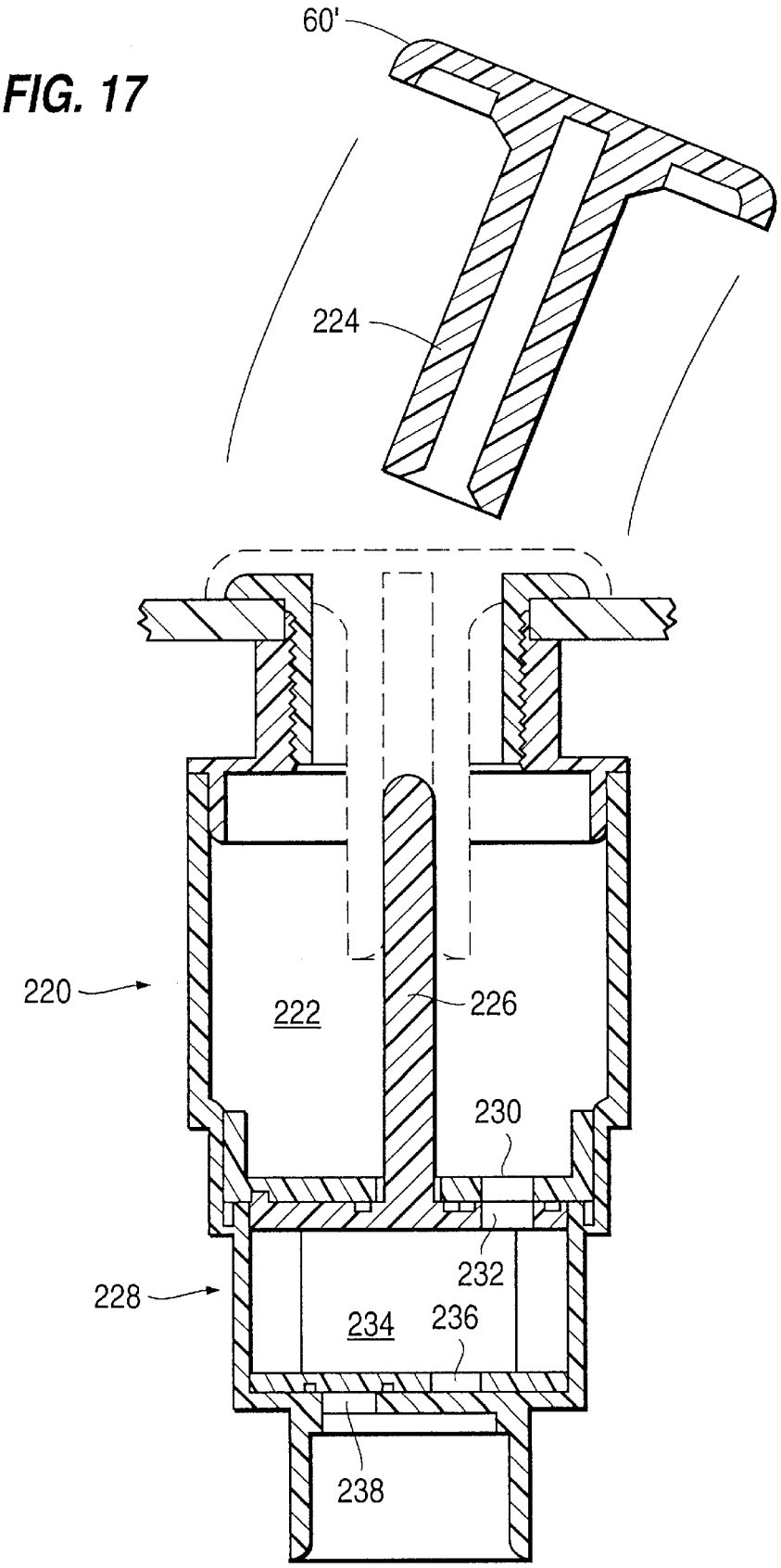
FIG. 17 is a side elevational view, in cross-section, of a second embodiment of a cleaning unit of the system of the present invention.

A second embodiment of cleaning-agent dispenser is shown in elevational cross-section in FIG. 17 and is designed to accept a liquid cleaning agent rather than the solid cleaning agent of FIG. 16. As shown, the cleaning-agent dispenser 220 includes a chamber 222 into which a liquid cleaning agent is poured when the cap 60' is removed. The removeable cap 60' includes a slotted stem 224 that fits over a flattened tab 226 of a rotatable fill valve 228. When the rotatable fill valve 228 is rotated to a fill position, as shown in FIG. 17, inlet openings 230 and 232 are in registration to allow liquid cleaning agent to flow into a liquid-receiving chamber 234. When the rotatable fill valve 228 is in its fill position, outlet openings, 236 and 238, in the lower portion of the liquid-receiving chamber 234, are out of registration to prevent any discharge from the liquid-receiving chamber 234. When the flattened tab 226 of the rotatable valve 228 is rotated one-half turn the outlet openings 236 and 238 move into registration with one another to discharge the volume of liquid cleaning agent in the liquid-receiving chamber 234 into the outlet 210 for mixing with the pressurized inlet water stream.

In FIG. 2, the cleaning-agent dispenser 58 is shown as connected (dotted-line illustration) to the water circuit 32 via a fitting 72. The particular connection shown is exemplary. The cleaning-agent dispenser 58 can be connected into the suction pipe 46 as represented by the fitting 240 (dotted-line illustration), into any one of the stand pipes 38 as represented by the fitting 242 (dotted-line illustration), or into the inlet side of the recirculation pump 40 as represented by the fitting 244 (dotted-line illustration). As can be appreciated from the above, the water circuit 32, the suction pipe 46 connected to the inlet of the recirculation pump 40, the outlet pipe 48 connecting the outlet of the recirculation pump 40 to the water circuit 32, and the water circuit 32 represent a water-path to which the cleaning agent dispenser can be connected at any convenient point including through any one of the afore-described water circuit fittings.

In the normal whirlpool mode of the preferred embodiment using the integrated suction inlet and valve assembly 300, the water-air jets 30 opened, the drain opening 26 is closed, and the basin 18 is filled by the user with an appropriate amount of water at the desired temperature. The water may be supplied from a conventional faucet assembly or may be supplied through the cleaning-agent dispenser 58. Once the basin 18 is filled, the recirculation pump 40 is turned on so that a pressurized water/air mix is jetted into the basin 18 from the water-air jets 30 with water being withdrawn from the basin 18 through the suction inlet 42. In this normal mode of operation, the valve disc 284 will flex to its open position (FIG. 8) to allow substantially unrestricted flow through the suction inlet 42. After normal use, the recirculation pump 40 is shut-off and the drain opening 26 is opened to drain the water from the tub 12.

In the cleaning mode of operation, both lower most water-air jets 30 (in the footwall 20) are opened with the remaining water-air jets 30 closed. Where the tub system includes a cleaning-agent dispenser 58 of the type shown in FIG. 16, a solid tablet 216 of a detergent, deodorizer, and/or disinfectant is placed into the cleaning-agent dispenser 58. Where the tub system includes a cleaning-agent dispenser 220 (FIG. 17), an appropriate quantity of a liquid cleaning agent is introduced into the cleaning-agent dispenser 220 for discharge into the water path. With the recirculation pump 40 turned off, water is introduced into the dispenser via the hot-water line 64 and/or cold-water line 66 to mix with the cleaning agent. In the case of the preferred embodiment, the cleaning solution enters the water circuit 32 through the water circuit fitting 72. The water circuit 32 is filled with cleaning solution with the solution flowing into the outlet pipe 48, into the recirculation pump 40, the suction pipe 46, and into the suction inlet of the recirculation pump 40. The valve disc 284, in response to the water pressure, will flatten against disc clamp 286 to the substantially closed position as shown in solid-line illustration in FIG. 10. Additionally, the cleaning solution flows upwardly into the stand pipes 38. Since the respective air valve assemblies 116 are closed, the cleaning solution will rise to a level determined by the pressure of the water supplied through the cleaning-agent dispenser 58. The cleaning solution is thus infused through the entire water path. The cleaning solution will displace any air from the integrated suction inlet and valve assembly 300 and will fill the various interstices of the suction inlet 42 with the cleaning solution discharging through the discharge opening 296. In a similar manner, the open lowestmost water-air jets 30 (in the foot wall 20, FIG. 1) will also discharge cleaning solution into the basin 18. The discharged cleaning solution will drain from the basin 18 via the drain opening 26. The water supply flow can be maintained for a time period long enough to ensure that the interior surfaces of the water path are wetted and cleaned. Thereafter, the water supply is discontinued and the water in the system will drain through the discharge opening 296 and the opened water-air jets 30. The cross-sectional area of the discharge opening 296 is selected to assure that cleaning solution will drain from the water path through the suction pipe 46 over a period of time. For a valve disc 284 approximately 1.8 inches in diameter, a discharge discharge opening 296 having an area of about 0.250 square inches is preferred.

In those embodiments in which the manually operable suction valve 44 or the manually operable valved suction inlet 250 is used, the user manually closes the suction path valve as part of the self-cleaning mode. In the case of the suction valve 44 and as shown in FIG. 1, a control rod 54 (dotted-line illustration) extends from the suction valve 44 through the top sill 14 and terminates in an open/close knob 56 that can be rotated in one direction or the other to open or close the suction valve 44.

Figure 18:
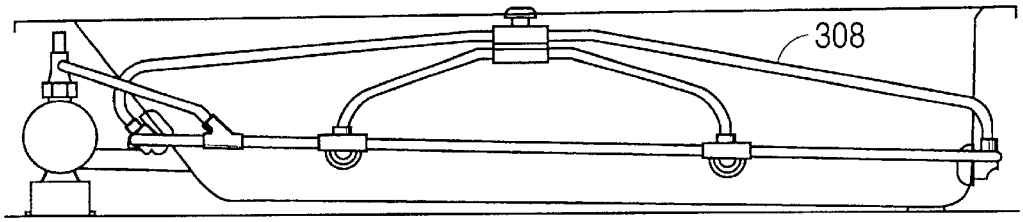
FIG. 18 is a side view of an alternate arrangement of air supply tubes.
Figure 19:
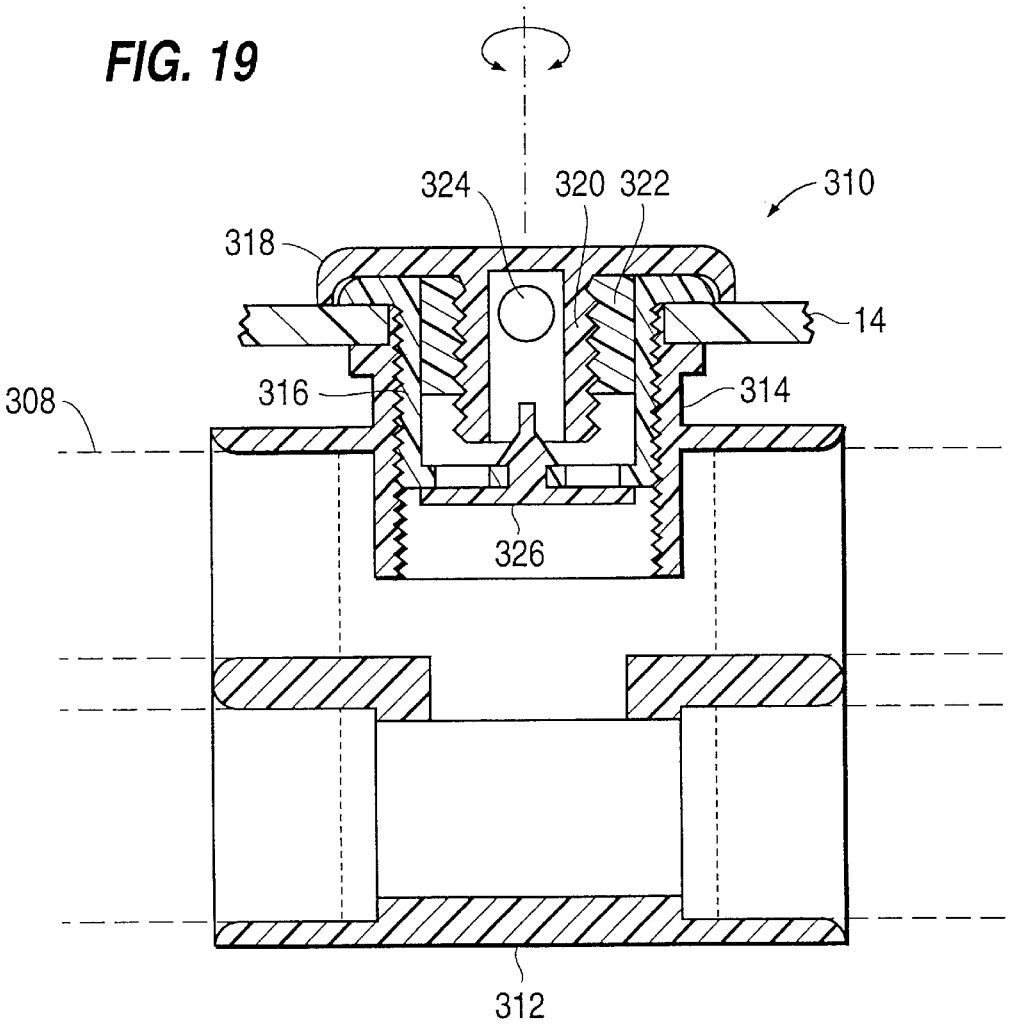
FIG. 19 is a side view, in cross section, of a user-controllable air-entry valve.

In the embodiment described above, the stand pipes 38 are shown as terminating at their distal ends with a valve cartridge. If preferred and as shown in FIG. 18, air tubes 308 can be substituted for the stand pipes 38 and connected to a user-controllable air-entry valve 310. As shown in FIG. 19, the air-entry valve 310 includes a manifold 312 having inlets that accept the ends (dotted-line illustration) of the various air tubes 308. An internally threaded collar 314 extends upwardly from the manifold 312 and is held in place in a throughbore (unnumbered) in the tub sill 14 by an externally threaded insert 316. A user-rotatable control knob 318 is received within the insert 316 and includes an externally treaded, axially extending stem 320 that engages an internally threaded member 322. The stem 320 includes a port 324 through which ambient air can enter the manifold 312 for distribution into the air tubes 308. A resilient valve disc 326 is mounted to the bottom of the member 322 and operates in a manner analogous to the cartridge valves of FIG. 3. In operation, the user can control the amount of air drawn into the water stream by rotating the control knob 318 to admit more or less air. The resilient valve disc 326 operates to prevent undesired and inadvertent discharge of water through the port 324.

The present invention advantageously provides a pressurized-flow self-cleaning whirlpool tub system and method in which the interior of the surfaces of the water carrying conduits are cleaned under pressurized water flow without the system complexities associated with the prior art.

As will be apparent to those skilled in the art, various changes and modifications may be made to the illustrated pressurized-flow self-cleaning whirlpool tub system and method of the present invention without departing from the spirit and scope of the invention as determined in the appended claims and their legal equivalent.

What is claimed is:

1. A self-cleaning system for whirlpool tubs comprising:

a plurality of water jets for mounting in a wall of a tub structure;

a water distribution circuit for distributing water to said water jets;

a suction inlet for mounting in a wall of the tub structure;

pump means having an inlet connected to said suction inlet and an outlet connected to said water distribution circuit for supplying water under pressure to said water distribution circuit;

a flow-control valve connected intermediate said inlet of said pump means and said suction inlet said flow-control valve comprising a resilient elastomer disc moveable between an open and a substantially closed position, said disc having an opening therein with a cross-sectional area substantially smaller than the cross-sectional area of said disc, the opening allowing a small flow of water therethrough when said disc is in its substantially closed position;

said water distribution circuit, pump means, and the inlet and outlet connections thereof defining a water path; and means for receiving a quantity of a cleaning agent and mixing the cleaning agent with a supply of pressurized water, said receiving means in fluid communication with said water path for supplying mixed cleaning agent and pressurized water thereto to effect cleaning thereof, a portion of the mixed cleaning agent and pressurized water flowing through said flow-control valve when in its substantially closed position.

2. The self-cleaning system for whirlpool tubs of claim 1, wherein said water jets comprise:

a housing having a water inlet connected to said water distribution circuit for receiving water therefrom and having an air inlet for admitting air;

a core assembly including a user-adjustable nozzle for directing a flow of water and admitted air therefrom and a user-adjustable valve intermediate the inlet and nozzle for adjusting the flow of water therethrough;

said air inlet including a conduit extending from the housing and having an air valve for controlling the admission of air into said air inlet and for preventing flow in an opposite direction.

* * * * *